US009662904B2

(12) United States Patent
Yamashita

(10) Patent No.: US 9,662,904 B2
(45) Date of Patent: May 30, 2017

(54) RECORDING APPARATUS AND RECORDING METHOD

(71) Applicant: SEIKO EPSON CORPORATION, Tokyo (JP)

(72) Inventor: Norihiro Yamashita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/124,707

(22) PCT Filed: Mar. 26, 2015

(86) PCT No.: PCT/JP2015/001743
§ 371 (c)(1),
(2) Date: Sep. 9, 2016

(87) PCT Pub. No.: WO2015/146182
PCT Pub. Date: Oct. 1, 2015

(65) Prior Publication Data

US 2017/0015113 A1 Jan. 19, 2017

(30) Foreign Application Priority Data

Mar. 26, 2014 (JP) ..... 2014-063272

(51) Int. Cl.
*B41J 2/01* (2006.01)
*B41J 11/00* (2006.01)
(Continued)

(52) U.S. Cl.
CPC ..... *B41J 11/0015* (2013.01); *B41J 2/01* (2013.01); *B41J 3/4078* (2013.01); *B41J 11/06* (2013.01); *D06B 11/00* (2013.01); *D06P 7/00* (2013.01)

(58) Field of Classification Search
CPC ... B41M 1/34; B41M 5/52; B41M 7/00; B41J 2/01; B41J 11/0015; B41J 2/2114
See application file for complete search history.

(56) References Cited

U.S. PATENT DOCUMENTS 6,084,607 A * 7/2000 Matsuda ..... B41J 2/01 347/19
6,332,664 B1 * 12/2001 Kanazawa ..... B41J 2/01 347/104

(Continued)

OTHER PUBLICATIONS

International Search Report dated Jun. 9, 2015 for PCT/JP2015/001743.

*Primary Examiner* — Kristal Feggins
(74) *Attorney, Agent, or Firm* — Workman Nydegger

(57) ABSTRACT

A recording apparatus includes a medium setting section on which a recording medium (M) is set; a recording section that records an image on the recording medium set on the medium setting section; and a medium moving section that reciprocates the medium setting section with respect to the recording section. The recording section includes a pretreatment section that supplies a pretreatment liquid to the recording medium when the medium setting section moves in a first direction, a leveling section that is provided on a further downstream side with respect to the pretreatment section in the first direction and levels a recording surface of the recording medium when the medium setting section moves in the first direction, and a supplying section that supplies ink to a leveled recording surface when the medium setting section moves in a second direction.

7 Claims, 6 Drawing Sheets

(51) Int. Cl.

| | |
|---|---|
| ***D06P 7/00*** | (2006.01) |
| ***D06B 11/00*** | (2006.01) |
| ***B41J 3/407*** | (2006.01) |
| ***B41J 11/06*** | (2006.01) |

(56) References Cited

U.S. PATENT DOCUMENTS

| | | | | |
|---|---|---|---|---|
| 6,332,680 | B1 * | 12/2001 | Ozawa | B41J 2/01 347/104 |
| 2011/0032319 | A1 | 2/2011 | Kaplan | |
| 2014/0284177 | A1 * | 9/2014 | Chiba | B41J 2/01 198/497 |
| 2014/0354721 | A1 * | 12/2014 | Kondo | B41J 2/01 347/9 |

* cited by examiner

RECORDING APPARATUS AND RECORDING METHOD

TECHNICAL FIELD

The present invention relates to a recording apparatus that supplies pretreatment liquid and ejects ink on a recording medium, and a recording method.

BACKGROUND ART

In the related art, a printing apparatus including a printing table on which clothes are set with respect to a recording medium, a humidification head that moistens the clothes, a leveling section that levels a surface of wet clothes, a printing head that ejects ink on the clothes of which a surface is leveled, and rails that guide movement of the printing table with respect to the humidification head, the leveling section, and the printing head is known. In the printing apparatus, the leveling section is provided between the humidification head and the printing head (see PTL 1).

CITATION LIST

Patent Literature

PTL 1: US Unexamined Patent Application Publication No. 2011/0032319

SUMMARY OF INVENTION Technical Problem

In the printing apparatus of the related art, the printing table does not reciprocate with respect to the humidification head, the leveling section, and the printing head when recording an image on clothes.

An object of the invention is to provide a recording apparatus that can perform a leveling operation while performing a pretreatment operation when recording an image on a recording medium while relatively reciprocating a medium setting section with respect to a recording section, and a recording method.

Solution to Problem

A recording apparatus of the invention includes a medium setting section on which a recording medium is set; a recording section that records an image on the recording medium set on the medium setting section; and a medium moving section that relatively reciprocates the medium setting section with respect to the recording section in a first direction and a second direction opposite to the first direction. The recording section includes a pretreatment section that supplies a pretreatment liquid to the recording medium set on the medium setting section when the medium setting section relatively moves in the first direction, a leveling section that is provided on a further downstream side with respect to an the pretreatment section in the first direction and levels a recording surface of the recording medium to which the pretreatment liquid is supplied when the medium setting section relatively moves in the first direction, and a supplying section that supplies ink to a leveled recording surface when the medium setting section relatively moves in the second direction.

A recording method of the invention is a recording method in a recording apparatus including a recording section that includes a pretreatment section that supplies a pre-treatment liquid to a recording medium, a leveling section that is provided on a further downstream side with respect to the pretreatment section in a first direction and levels a recording surface of the recording medium, and a supplying section that supplies ink to the recording medium; and a medium moving section that relatively reciprocates the recording section with respect to the recording medium in the first direction and a second direction opposite to the first direction, the recording method including: supplying the pretreatment liquid to the recording medium and leveling the recording surface to which the pretreatment liquid is supplied when the recording section relatively moves in the first direction with respect to the recording medium; and supplying ink to a leveled recording surface when the recording section relatively moves with respect to the recording medium in the second direction.

According to this configuration, the leveling section is provided on the further downstream side with respect to the pretreatment section in the first direction and thereby when the medium setting section relatively moves in the first direction, the pretreatment section can perform a pretreatment operation of supplying the pre-treatment liquid to the recording medium and the leveling section can perform a leveling operation leveling the recording surface.

In this case, it is preferable that the medium setting section has a medium mounting surface on which the recording medium is mounted, and the recording apparatus further includes a first floating detection section that is provided on a further upstream side with respect to the supplying section in the second direction and detects presence or absence of floating of the recording medium with respect to the medium mounting surface.

According to this configuration, even if the recording medium is swollen by the pre-treatment liquid supplied when the medium setting section relatively moves in the first direction and is floated with respect to the medium mounting surface, it is possible to detect the floating by the first floating detection section before generated floating relatively passes through a supplying section, when the medium setting section relatively moves in the second direction.

In this case, it is preferable that a separation distance between the first floating detection section and the supplying section is greater than a dimension of the medium mounting surface in a reciprocation direction of the medium setting section.

According to this configuration, the medium mounting surface relatively passes through the supplying section after an entirety of the medium mounting surface relatively passes through the first floating detection section, when the medium setting section relatively moves in the second direction. Thus, presence or absence of floating is detected by the first floating detection section for the entirety of the recording medium before an ejecting operation is performed. Thus, floating may be detected by the first floating detection section and even if the relative movement of the medium setting section in the second direction is stopped, the ejecting operation is not suspended.

In this case, it is preferable that the recording section further includes a housing in which the pretreatment section, the leveling section, and the supplying section are housed, and an entrance is provided, and the medium moving section moves the medium setting section from a moving start position provided outside of the housing to a returning position provided inside of the housing with respect to the recording section in the first direction, and moves the medium setting section from the returning position to the moving start position in the second direction.

According to this configuration, a user can set the recording medium on the medium setting section in a state where the medium setting section is positioned at the moving start position that is outside of the housing.

In this case, it is preferable that the medium setting section has the medium mounting surface on which the recording medium is mounted, and the recording apparatus further includes a second floating detection section that is provided on a further upstream side with respect to the supplying section in the first direction and detects presence or absence of floating of the recording medium with respect to the medium mounting surface.

According to this configuration, if the recording medium is floated when being set on the medium setting section, the floating is detected by the second floating detection section through which the medium setting section is firstly passed when moving from the recording start position in the first direction. The second floating detection section is provided on the further upstream side with respect to the supplying section in the first direction and is positioned relatively near the entrance. Thus, if the movement of the medium setting section is stopped by detecting floating by the second floating detection section, the user can easily see where the floating of the recording medium occurs through the entrance.

In this case, it is preferable that the pretreatment section includes a spray head that sprays the pretreatment liquid, and the recording section further includes a partition member that partitions the spray head from the supplying section.

According to this configuration, the partition member is provided between the spray head and the supplying section, and thereby it is possible to prevent the pretreatment liquid sprayed from the spray head being applied to the supplying section.

DESCRIPTION OF EMBODIMENTS

Figure 1:
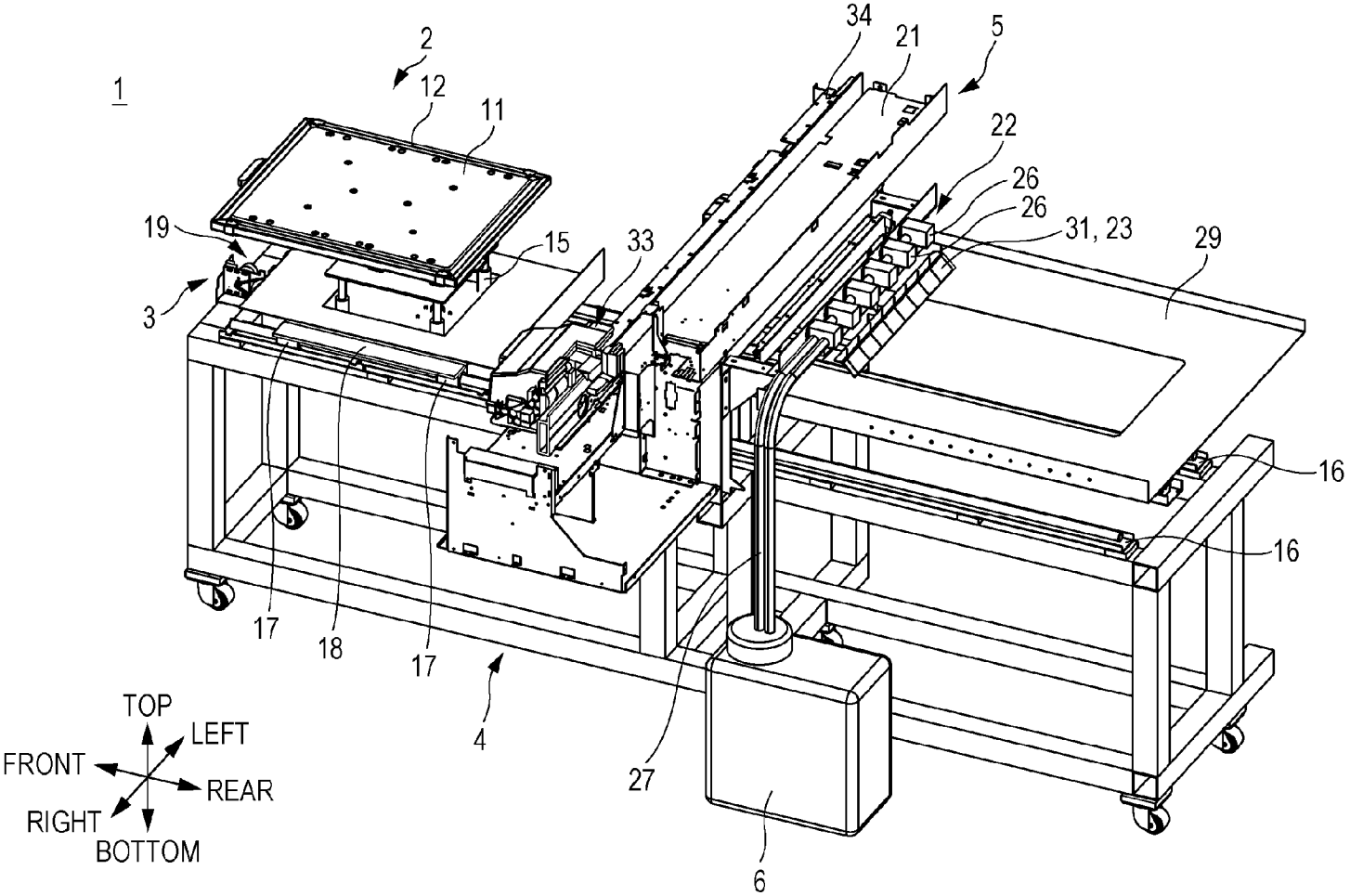
FIG. 1 is a perspective view of a state where a housing is removed in a recording apparatus according to an embodiment of the invention.

Hereinafter, a recording apparatus according to an embodiment of the invention will be described with reference to accompanying drawings. The recording apparatus performs recording of an image on a recording medium such as T-shirts by ejecting ink by an ink jet type.

Moreover, hereinafter, the description is given using directions toward "top", "bottom", "left", "right", "front", and "rear" illustrated in the drawings, but the directions are given for the sake of convenience of the description, and the embodiment of the invention is not limited to usage of those directions.

Figure 2:
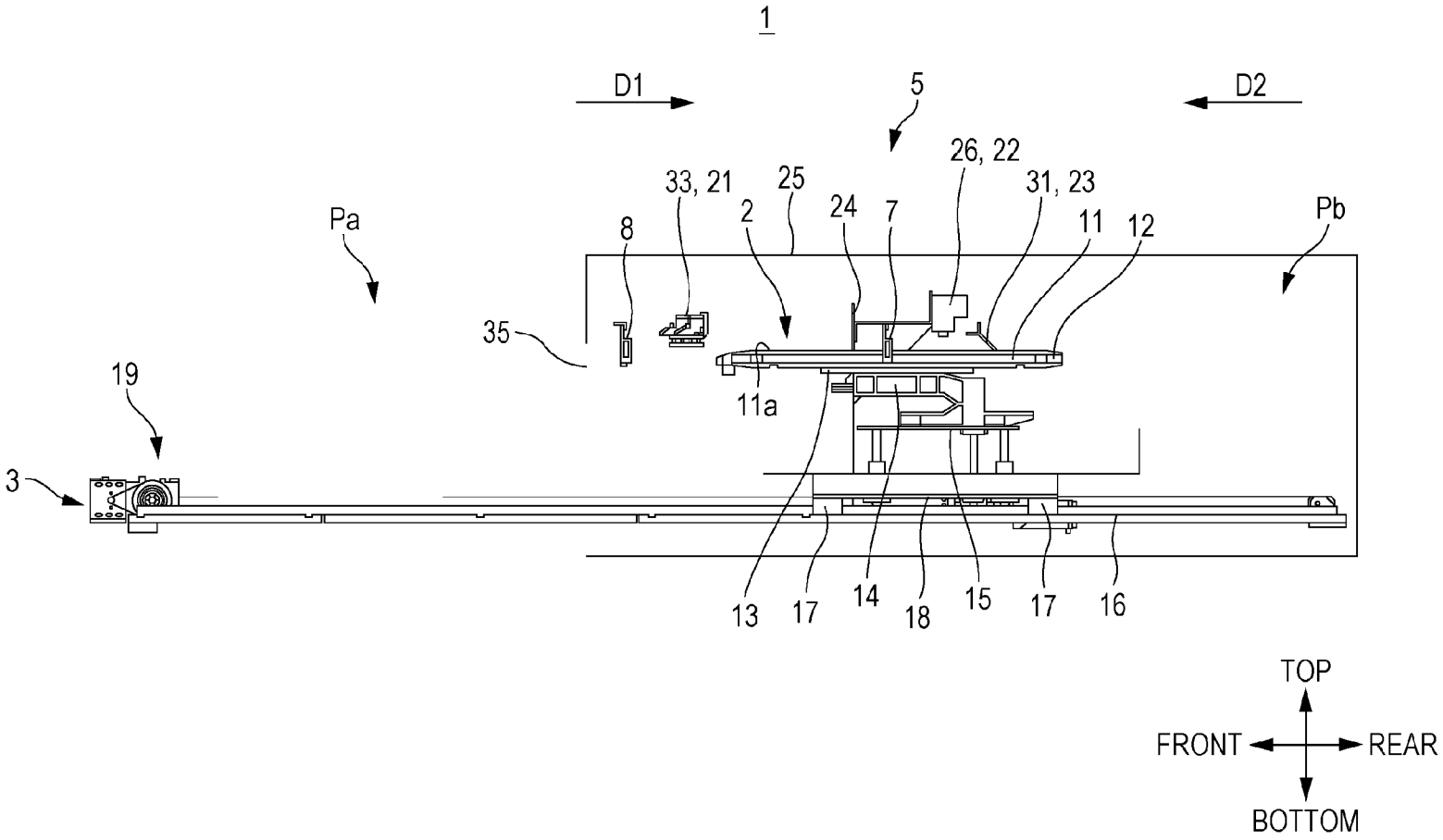
FIG. 2 is a right side view illustrating main configuration elements of the recording apparatus.

As illustrated in FIGS. 1 and 2, a recording apparatus 1 includes a medium setting section 2 on which a recording medium M (see FIGS. 4A to 4F) is set, a medium moving section 3 that reciprocates the medium setting section 2 in the front and rear direction, a frame 4 on which the medium moving section 3 is mounted on an upper surface, a recording section 5 extending in the right and left direction, and a pre-treatment liquid tank 6 in which a pretreatment liquid that is supplied to a spray head 26 (described below) of the recording section 5 is stored. Furthermore, the recording apparatus 1 includes a first floating detection section 7 that is provided between an ejecting section 21 (described below) of the recording section 5 and a pretreatment section 22, and a second floating detection section 8 that is provided in front of the ejecting section 21.

The medium setting section 2 includes a tray 11 on which the recording medium M is mounted on a medium mounting surface 11*a* of an upper surface thereof, a holding frame 12 that holds the recording medium M between the holding frame 12 and the tray 11, a tray mounting section 13 on which the tray 11 is detachably mounted, a base section 14 that supports the tray mounting section 13, and a height adjustment mechanism 15 that is provided on the medium moving section 3 and adjusts a height of the tray 11 through the base section 14.

The user sets the recording medium M on the medium setting section 2 by fitting the holding frame 12 in the tray 11 after the recording medium M is mounted on medium mounting surface 11*a* of the tray 11. At this time, the user sets the recording medium M on the medium setting section 2 in a state where a recording surface Ma (see FIGS. 4A to 4F) of the recording medium M, that is, a surface on which an image is recorded is upward.

The medium moving section 3 slides (moves) the medium setting section 2 in the front and rear direction between a moving start position Pa provided in the front and a returning position Pb provided in the rear. The moving start position Pa is provided outside of a housing 25 (described below) of the recording section 5 and is a position at which the user sets the recording medium M on the medium setting section 2. Meanwhile, the returning position Pb is provided inside of the housing 25.

Moreover, a direction from the moving start position Pa to the returning position Pb, that is, a direction from the front to the rear is referred to as "first direction D1" and a direction from the returning position Pb to the moving start position Pa, that is, from the rear to the front is referred to as "second direction D2".

The medium moving section 3 includes two right/left linear guides 16 extending in the front and rear direction, right/left two-pair sliders 17 that slide in the front and rear direction along each linear guide 16, a slide table 18 which is passed between the right/left two-pair sliders 17 and on which the medium setting section 2 is mounted on an upper surface thereof, and a table moving mechanism 19 that moves the slide table 18 in the front and rear direction. The table moving mechanism 19 is constituted by a belt mechanism driven by a motor.

The recording section 5 performs recording of an image on the recording medium M set in the medium setting section 2. The recording section 5 includes the ejecting section 21 and the pretreatment section 22 provided in the rear of the ejecting section 21, a leveling section 23 provided in the rear of the pretreatment section 22, a partition member 24 provided between the ejecting section 21 and the pretreatment section 22, a pretreatment receiving section 29 provided to extend from a bottom to a top of the pretreatment section 22, and the housing 25 housing these sections and member.

The pretreatment section 22 includes six spray heads 26 arranged in a line in the right and left direction. Each spray head 26 sprays the pretreatment liquid from above to the recording medium M set in the medium setting section 2. Of course, the number of spray heads 26 is arbitrary. Moreover, in the embodiment, the pretreatment section 22 is constituted by the spray heads 26, but the pretreatment section 22 is not limited to the embodiment, and, for example, may be constituted by an ink jet head.

The pretreatment liquid is supplied from the pretreatment liquid tank 6 to the spray head 26 through a supply tube 27. Switching between spraying/not spraying the pre-treatment liquid from the spray head 26 is performed by opening and closing an opening/closing valve 28 (see FIG. 3) provided in the supply tube 27. For example, the opening/closing valve 28 may be constituted by a solenoid valve.

For example, the pretreatment liquid is used to promote fixation of white ink to the recording medium M. In this case, the spray head 26 sprays the pretreatment liquid only when the ejecting section 21 ejects white ink. Moreover, as described below, the ejecting section 21 ejecting white ink is a case where an image is recorded on the recording medium M having a dark color such as black. Of course, each spray head 26 may spray the pretreatment liquid on any recording medium M. For example, as the pretreatment liquid, if the ejecting section 21 ejects a pigment ink, it is possible to use an aqueous solution containing an aggregating agent that aggregates the pigment. As the aggregating agent, for example, polyvalent metal salt is preferred.

The leveling section 23 levels the recording surface Ma of the recording medium M to which the pretreatment liquid is sprayed.

It is possible to constantly and sufficiently penetrate the pretreatment liquid into the recording medium M and to prevent the recording surface Ma from fluffing by leveling the recording surface Ma. The leveling section 23 includes a leveling member 31 and a leveling driving section 32 (see FIG. 3) that drives the leveling member 31. For example, as the leveling member 31, it is possible to use a plastic plate, a metal plate, a wooden paddle, and the like. The leveling driving section 32 moves the leveling member 31 between a leveling position at which it is capable of coming in contact with the recording surface Ma and a non-leveling position separated upward from the recording surface Ma. For example, the leveling driving section 32 is constituted by an air cylinder. Moreover, the leveling section 23 is not limited to using the leveling member 31 and, for example, as air blow, leveling may be performed by air pressure and the like without coming in contact with the recording surface Ma.

The pretreatment receiving section 29 is formed in the shape of a plate having a substantially "U" shape in a top view so as to surround the right, left, and rear of the tray 11 moved to the returning position Pb. A left side portion and a right side portion of the pretreatment receiving section 29 are bent upward. The pretreatment receiving section 29 receives the pretreatment liquid flying in the air which has not attached to the recording medium M or the pretreatment liquid protruding from the recording surface Ma of the recording medium M when the recording medium M is leveled by the leveling section 23 in the pretreatment liquid sprayed from the pretreatment section 22. It is possible to prevent the pretreatment liquid from erroneously attaching to the linear guide 16 or other members by providing the pretreatment receiving section 29.

The ejecting section 21 ejects the ink on the recording surface Ma of the recording medium M that is leveled in an ink jet type. The ejecting section 21 includes a plurality of ejecting heads 33 corresponding to the number of the ink to be ejected and a head moving mechanism 34 that reciprocates the plurality of ejecting heads 33 in the right and left direction. The colors of the inks are not specifically limited and it is possible to appropriately use cyan, magenta, yellow, black, white, and the like. The white ink is, for example, used for forming a white base in a case where an image is recorded on the recording medium M having a dark color such as black. Furthermore, as the ink, it is possible to appropriately use a pigment ink. The head moving mechanism 34 is constituted by a belt mechanism driven by a motor.

The partition member 24 has a long plate shape in the right and left direction, and partitions the ejecting section 21 from the pretreatment section 22. It is possible to prevent the pretreatment liquid sprayed from the spray head 26 being applied to the ejecting section 21 and to prevent the ejecting section 21 from being degraded due to the pretreatment liquid by providing the partition member 24.

The housing 25 has a substantially rectangular parallelepiped shape horizontally long and has a substantially rectangular entrance 35 on a front surface, through which the medium setting section 2 goes in and out. That is, the medium setting section 2 reciprocates in the front and rear direction through the entrance 35 between the moving start position Pa and the returning position Pb. The user can set the recording medium M on the medium setting section 2 in a state where the medium setting section 2 is positioned at the moving start position Pa that is outside of the housing 25. Furthermore, the ejecting section 21, the pretreatment section 22, and the leveling section 23 are provided in this order from the entrance 35 to the returning position Pb. Thus, the ejecting section 21 is provided near to the entrance 35 and thereby it is possible to improve accessibility to the ejecting section 21. Thus, the user can easily perform maintenance work and the like on the ejecting section 21.

The first floating detection section 7 and the second floating detection section 8 detect presence or absence of floating of the recording medium M with respect to the medium mounting surface 11*a*. For example, the first floating detection section 7 and the second floating detection section 8 can be constituted by a separation type photo-interrupter provided so that a light emitting section and a light receiving section cross a moving path of the medium setting section 2 in the right and left direction. The first floating detection section 7 and the second floating detection section 8 are provided at height positions to block detection light from the light emitting section by floating if the recording medium M is floated so that a gap between a nozzle surface of the ejecting section 21 and the recording surface Ma of the recording medium M becomes a predetermined value or less. Thus, when the ejecting section 21 ejects the ink while reciprocating n the right and left direction, the floating of the recording medium M can be prevented from abutting the nozzle surface of the ejecting section 21. Moreover, the height positions at which the first floating detection section 7 and the second floating detection section 8 are mounted substantially coincide with each other in the embodiment, but may be different from each other.

If the recording medium M is floated when being set on the medium setting section 2, the floating is detected by the second floating detection section 8 through which the medium setting section 2 is firstly passed when moving rearward from the moving start position Pa that is, in the first direction D1. As described above, the second floating detection section 8 is provided in the front of the ejecting section 21 and is positioned relatively near the entrance 35. Thus, as described below, if the movement of the medium setting section 2 is stopped by detecting floating by the second floating detection section 8, the user can easily see through the entrance 35 where the floating of the recording medium M occurs.

Meanwhile, even if there is no floating of the recording medium M when being set on the medium setting section 2 and floating is not detected by the second floating detection section 8 and the first floating detection section 7 when the medium setting section 2 moves in the first direction D1, thereafter, the recording medium M may become swollen by spraying the pretreatment liquid from the pretreatment section 22 and floating of the recording medium M may occur when the medium setting section 2 moves forward from the returning position Pb that is, in the second direction D2. In this case, floating is detected by the first floating detection section 7 through which the medium setting section 2 firstly passes when moving in the second direction D2. Then, since the first floating detection section 7 is provided further rearward than the ejecting section 21, it is possible to detect the floating by the first floating detection section 7 before the floating passes through the ejecting section 21.

Moreover, in the embodiment, a separation distance L1 between the ejecting section 21 and the first floating detection section 7 in a forward and rearward direction is smaller than a dimension L2 of the medium mounting surface 11*a*. In this case, when the medium setting section 2 moves in the second direction D2, a front end of the medium mounting surface 11*a* passes through the ejecting section 21 before a rear end of the medium mounting surface 11*a* passes through the first floating detection section 7 (see FIG. 4E).

Figure 3:
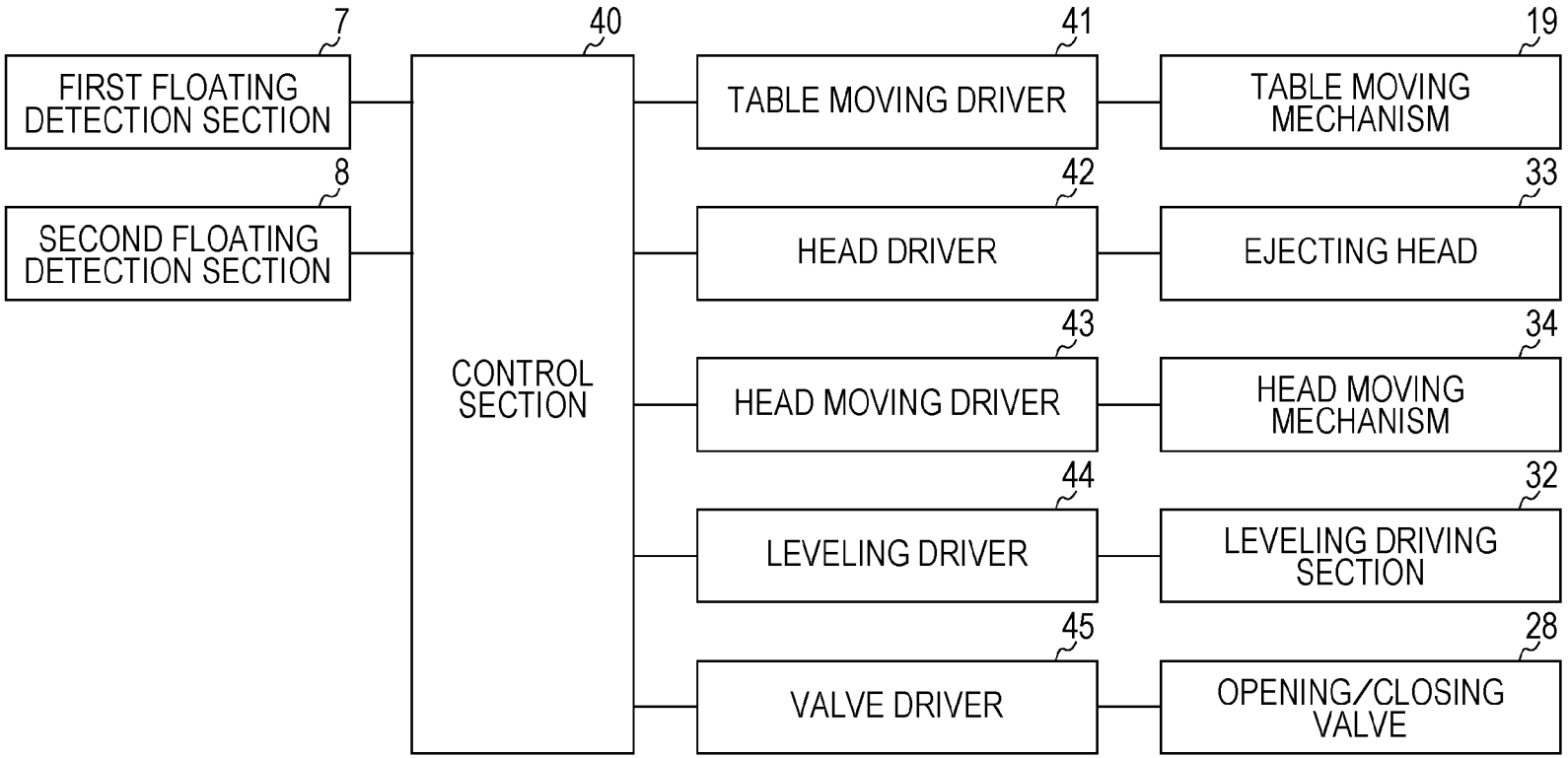
FIG. 3 is a block diagram illustrating a control system of the recording apparatus.

A control system of the recording apparatus 1 will be described with reference to FIG. 3. The recording apparatus 1 includes the table moving mechanism 19, the ejecting head 33, the leveling driving section 32, the opening/closing valve 28, the first floating detection section 7, the second floating detection section 8, and a control section 40. Furthermore, the recording apparatus 1 includes a table moving driver 41 for driving the table moving mechanism 19, a head driver 42 for driving the ejecting head 33, a head moving driver 43 for driving the head moving mechanism 34, a leveling driver 44 for driving the leveling driving section 32, and a valve driver 45 for driving the opening/closing valve 28.

The control section 40 includes a Central Processing Unit (CPU) or various storage devices, and the like, and collectively controls the entire apparatus. The control section 40 outputs control signals to the table moving driver 41, the head driver 42, the head moving driver 43, the leveling driver 44, and the valve driver 45. The table moving driver 41, the head driver 42, the head moving driver 43, the leveling driver 44, and the valve driver 45 drive the table moving mechanism 19, the ejecting head 33, the head moving mechanism 34, the leveling driving section 32, and the opening/closing valve 28 based on control signals from the control section 40. Furthermore, detection results of the first floating detection section 7 and the second floating detection section 8 are output to the control section 40.

A sequence of recording operations which are executed by the recording apparatus 1 will be described with reference to FIGS. 4A to 4F.

First, the user sets the recording medium M on the medium setting section 2 positioned at the moving start position Pa. At this time, the leveling member 31 is positioned at a non-leveling position (see FIG. 4A).

Figure 4A:
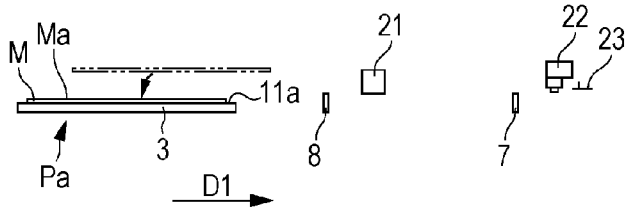
FIG. 4A is schematic diagram illustrating a sequence of a recording operation which is executed by the recording apparatus.
Figure 4B:
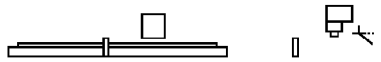
FIG. 4B is schematic diagram illustrating a sequence of a recording operation which is executed by the recording apparatus.
Figure 4C:
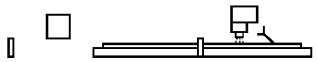
FIG. 4C is schematic diagram illustrating a sequence of a recording operation which is executed by the recording apparatus.

Thereafter, when the user performs the operation of the recording start, movement of the medium setting section 2 starts in the first direction D1 and the leveling member 31 moves to the leveling position (see FIG. 4B).

Subsequently, the opening/closing valve 28 is in an open valve state while the medium setting section 2 passes through the pretreatment section 22. Thus, pre-treatment liquid is sprayed from the pretreatment section 22 to the recording medium M set in the medium setting section 2. Furthermore, the leveling member 31 provided further rearward than the pretreatment section 22 and moved to the leveling position levels the recording surface Ma of the recording medium M to which the pretreatment liquid is sprayed (see FIG. 4C).

Here, if floating is detected by the second floating detection section 8 when the medium setting section 2 moves in the first direction D1, the control section 40 stops the movement of the medium setting section 2 in the first direction D1.

Furthermore, if floating is detected by the second floating detection section 8, the control section 40 moves the leveling member 31 to the non-leveling position, closes the opening/closing valve 28 if the opening/closing valve 28 is in the open valve state, and stops the spraying of the pretreatment liquid from the pretreatment section 22.

Figure 4D:
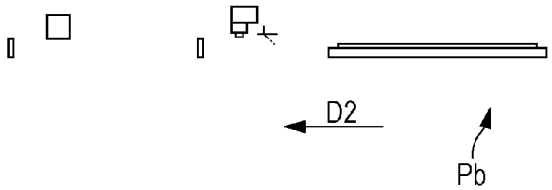
FIG. 4D is schematic diagram illustrating a sequence of a recording operation which is executed by the recording apparatus.

After the entirety of the medium setting section 2 passes through the pretreatment section 22, the opening/closing valve 28 is in a close valve state, and the spraying of the pretreatment liquid from the pretreatment section 22 is stopped, if the medium setting section 2 reaches the returning position Pb, the leveling member 31 moves to the non-leveling position (see FIG. 4D).

Figure 4E:
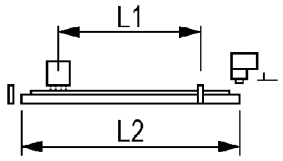
FIG. 4E is schematic diagram illustrating a sequence of a recording operation which is executed by the recording apparatus.
Figure 4F:
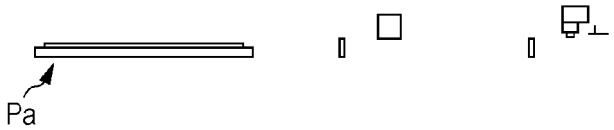
FIG. 4F is schematic diagram illustrating a sequence of a recording operation which is executed by the recording apparatus.

Subsequently, the medium setting section 2 intermittently moves in the second direction D2 and the ink is ejected while the ejecting section 21 reciprocates in the right and left direction with respect to the recording medium M set in the passing medium setting section 2 (see FIG. 4E). Thus, after the image is recorded on the recording medium M, the medium setting section 2 reaches the moving start position Pa (see FIG. 4F).

Moreover, the recording system of the embodiment may be of a serial type but may be of a line head type.

Here, as described above, even if there is no floating of the recording medium M when being set on the medium setting section 2 and floating is neither detected by the second floating detection section 8 nor the first floating detection section 7 when the medium setting section 2 moves in the first direction D1, thereafter, the recording medium M may become swollen by spraying the pretreatment liquid from the pre-treatment section 22 and floating of the recording medium M may occur when the medium setting section 2 moves in the second direction D2. In this case, the floating can be detected by the first floating detection section 7. If the floating is detected by the first floating detection section 7, the control section 40 stops the movement of the medium setting section 2 in the second direction D2.

Moreover, if the first floating detection section 7 or the second floating detection section 8 detects the floating, the control section 40 may notify the error to an operation panel (not illustrated) and the like in addition to stopping the movement of the medium setting section 2. If floating is detected by the first floating detection section 7 or the second floating detection section 8 and the movement of the medium setting section 2 is stopped, the user moves the medium setting section 2 to the moving start position Pa by operating a predetermined operation button. Subsequently, the user re-sets the recording medium M on the medium setting section 2 so as to resolve the floating of the recording medium M, and then performs the operation of the recording start.

As described above, according to the recording apparatus 1 of the embodiment, the leveling section 23 is provided on a further downstream side with respect to the pre-treatment section 22, that is, in the rear of the pretreatment section 22 in the first direction D1 and thereby when the medium setting section 2 moves in the first direction D1, the pre-treatment section 22 can perform the pretreatment operation in which the pretreatment liquid is sprayed to the recording medium M while he leveling section 23 levels the recording surface Ma. Furthermore, the ejecting operation by ejecting section 21 for ejecting the ink onto the recording medium M is performed when the medium setting section 2 moves in the second direction D2. Thus, it is possible to perform the ejecting operation separated from the leveling operation.

Figure 5A:
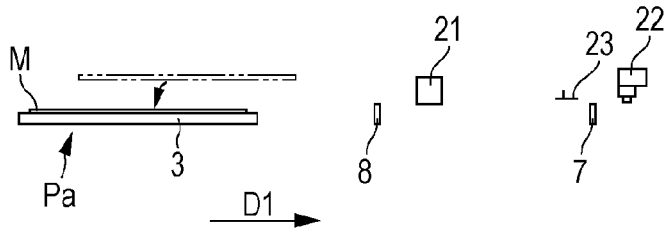
FIG. 5A is schematic diagram illustrating a sequence of a recording operation which is executed by a recording apparatus according to the related art.
Figure 5B:
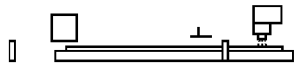
FIG. 5B is schematic diagram illustrating a sequence of a recording operation which is executed by a recording apparatus according to the related art.
Figure 5C:
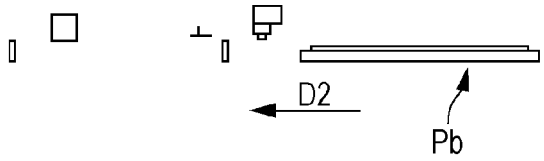
FIG. 5C is schematic diagram illustrating a sequence of a recording operation which is executed by a recording apparatus according to the related art.
Figure 5D:
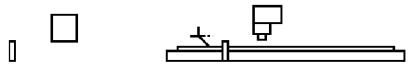
FIG. 5D is schematic diagram illustrating a sequence of a recording operation which is executed by a recording apparatus according to the related art.
Figure 5E:
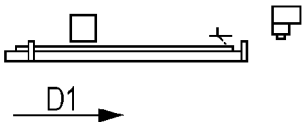
FIG. 5E is schematic diagram illustrating a sequence of a recording operation which is executed by a recording apparatus according to the related art.
Figure 5F:
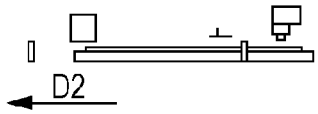
FIG. 5F is schematic diagram illustrating a sequence of a recording operation which is executed by a recording apparatus according to the related art.
Figure 5G:
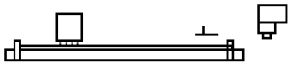
FIG. 5G is schematic diagram illustrating a sequence of a recording operation which is executed by a recording apparatus according to the related art.
Figure 5H:
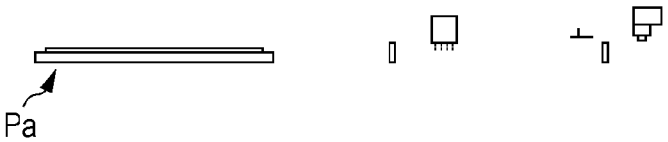
FIG. 5H is schematic diagram illustrating a sequence of a recording operation which is executed by a recording apparatus according to the related art.

Meanwhile, as illustrated in FIGS. 5A to 5H, if the leveling section 23 is provided on a further upstream side with respect to the pretreatment section 22, that is, in the front of the pretreatment section 22 in the first direction D1, since the pretreatment section 22 cannot perform the pretreatment operation while the leveling section 23 performs the leveling operation when the medium setting section 2 moves in the first direction D1, only the pretreatment operation is performed when the medium setting section 2 moves in the second direction D2 (see FIG. 5B) and the leveling operation is performed when the medium setting section 2 moves in the second direction D2 (see FIG. 5D). At this time, if the ejecting operation is performed together with the leveling operation, since the recording surface Ma is pressed during the ejecting operation, a posture change in the medium setting section 2 or a change in circumstances in the recording surface Ma is induced and there is a concern that image quality may be adversely affected.

In order to avoid this, when the medium setting section 2 moves in the second direction D2, first, only the leveling operation is performed and then the ejecting operation is performed, and thereby it is possible to separate the ejecting operation and the leveling operation. However, in this case, as illustrated in FIGS. 5A to 5H, if the leveling section 23 and the ejecting section 21 are disposed close to each other, the front end of the medium mounting surface 11*a*, that is, a recording start position passes through the ejecting section 21 when the entirety of the medium setting section 2 passes through the leveling section 23 (see FIG. 5E) and it is necessary to return the medium setting section 2 in the first direction D1 such that the ejecting section 21 faces the front end of the medium mounting surface 11*a* before the ejecting operation is performed (see FIG. 5F). Thus, when the recording is performed on the recording medium M, the medium setting section 2 moves in the first direction D1, the second direction D2, the first direction D1, and the second direction D2 in this order, and throughput decreases. Above all, although not specifically illustrated, if the leveling section 23 and the ejecting section 21 are disposed at positions separated by greater than the dimension of the medium setting section 2, since the front end of the medium mounting surface 11*a* on the medium setting section 2 does not pass through the ejecting section 21 when the entirety of the medium setting section 2 passes through the leveling section 23, it is not necessary to return the medium setting section 2 in the first direction D1 before the ejecting operation is performed. However, in this case, a size of the entirety of the apparatus is increased as the leveling section 23 and the ejecting section 21 are separated. As described above, if the leveling section 23 is provided on the further upstream side with respect to the pretreatment section 22 in the first direction D1, one of degradation of the image quality, decrease in the throughput, and the increase in the size of the entirety of the apparatus cannot be avoided.

On the other hand, according to the embodiment, as described above, since when the medium setting section 2 moves in the first direction D1, it is possible to perform the leveling operation while performing the pretreatment operation, and when the medium setting section 2 moves in the second direction D2, the ejecting operation is performed and the medium setting section 2 may move in the first direction D1 and the second direction D2 in this order when recording is performed on the recording medium M and thereby it is possible to improve the throughput. Furthermore, since the ejecting operation can be performed separately from the leveling operation, it is possible to prevent the leveling operation from adversely affecting the image quality. Furthermore, the size of the entirety of the apparatus is also not increased without it being necessary to dispose the leveling section 23 separately from the ejecting section 21.

Subsequently, a modified example of a recording apparatus 1 will be described. The recording apparatus 1 according to the modified example has a configuration similar to the recording apparatus 1 described above, but as illustrated in FIGS. 6A to 6G, is different from the recording apparatus 1 described above in that a separation distance L1 between the ejecting section 21 and the first floating detection section 7 in the front and rear direction is greater than a dimension L2 of a medium mounting surface 11*a*. Moreover, the description of the recording apparatus 1 described above is intended to apply equally to the recording apparatus 1 of the modified example, unless otherwise specified.

Figure 6A:
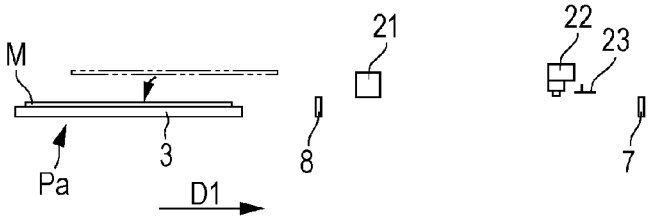
FIG. 6A is schematic diagram illustrating a sequence of a recording operation which is executed by a recording apparatus according to a modified example.
Figure 6B:
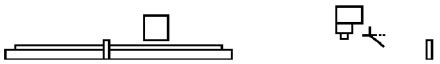
FIG. 6B is schematic diagram illustrating a sequence of a recording operation which is executed by a recording apparatus according to a modified example.
Figure 6C:
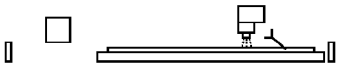
FIG. 6C is schematic diagram illustrating a sequence of a recording operation which is executed by a recording apparatus according to a modified example.
Figure 6D:
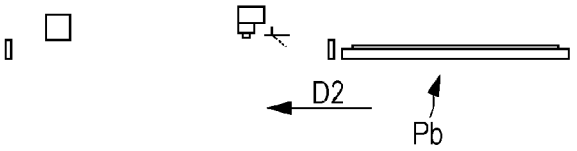
FIG. 6D is schematic diagram illustrating a sequence of a recording operation which is executed by a recording apparatus according to a modified example.
Figure 6E:
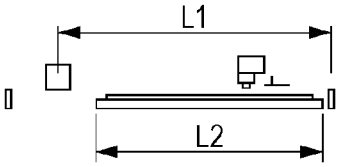
FIG. 6E is schematic diagram illustrating a sequence of a recording operation which is executed by a recording apparatus according to a modified example.
Figure 6F:
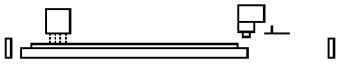
FIG. 6F is schematic diagram illustrating a sequence of a recording operation which is executed by a recording apparatus according to a modified example.
Figure 6G:
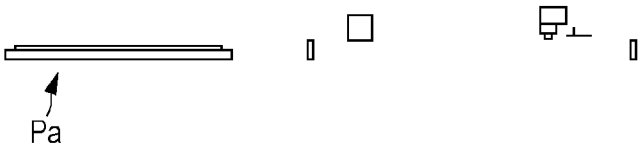
FIG. 6G is schematic diagram illustrating a sequence of a recording operation which is executed by a recording apparatus according to a modified example.

In the recording apparatus 1 of the modified example, when the medium setting section 2 moves in the second direction D2, after the rear end of the medium mounting surface 11*a* passes through the first floating detection section 7, the front end of the medium mounting surface 11*a* passes through the ejecting section 21 (see FIG. 6E). Thus, before the ejecting operation is performed, the presence or absence of floating is detected for the entirety of the recording medium M by the first floating detection section 7. That is, as described above, even if there is no floating of the recording medium M when being set on the medium setting section 2 and floating is neither detected by the second floating detection section 8 nor the first floating detection section 7 when the medium setting section 2 moves in the first direction D1, thereafter, the recording medium M may become swollen by spraying the pretreatment liquid from the pretreatment section 22 and floating of the recording medium M may occur when the medium setting section 2 moves in the second direction D2. However, also in this case, it is possible to detect the floating by the first floating detection section 7 before the ejecting operation is performed. Thus, even if the floating is detected and the movement of the medium setting section 2 in the second direction D2 is stopped, the ejecting operation is not suspended. Thus, it is possible to prevent wastage of the recording medium M, that is, an image being recorded only to halfway, from occurring.

Moreover, in the modified example, since the first floating detection section 7 is provided in the rear of the pretreatment section 22, if the recording medium M becomes swollen immediately after the pretreatment liquid is sprayed to the recording medium M by the pretreatment section 22, the generated floating is detected by the first floating detection section 7 when the medium setting section 2 moves in the first direction D1, but even in this case, there is no change in that the floating is detected by the first floating detection section 7 before the ejecting operation is performed.

Moreover, the medium moving section 3 in the embodiment may reciprocate the medium setting section 2 with respect to the recording section 5, may reciprocate the recording section 5 with respect to the medium setting section 2, or may reciprocate both the medium setting section 2 and the recording section 5.

Furthermore, the recording medium M is not particularly limited and, for example, can appropriately use a fabric and can particularly use clothes such as T-shirts.

Furthermore, the ejecting section 21, the pretreatment section 22, and the leveling section 23 in the embodiment are provided in this order from the entrance 35 to the returning position Pb. Thus, the ejecting section 21 is provided relatively near the entrance 35 and it is possible to improve accessibility to the ejecting section 21. Thus, the user can easily perform maintenance work and the like on the ejecting section 21.

Furthermore, in the embodiment, as floating detection sections, both the first floating detection section 7 and the second floating detection section 8 are provided, but the invention is not limited to the embodiment. More floating detection sections may be provided, and only one of the first floating detection section 7 and the second floating detection section 8 may be provided.

Furthermore, in the embodiment, floating of the recording medium M can be detected by using the first floating detection section 7 and the second floating detection section 8, but "floating" in the embodiment includes at least one of obstacles to the recording section 5 and obstacles to the recording medium M such as dirt or dust attached to the recording medium M, a solid erroneously mounted on the recording medium M, wrinkles or floating, and the like if the recording medium M is fabric.

The ejecting section 21 of the ink jet type as the supplying section is used, but the ink may be supplied to the recording medium M using another printing mechanism of a screen printing or thermal transfer type, and the like.

The entire disclosure of Japanese Patent Application No. 2014-063272, filed Mar. 26, 2014 is expressly incorporated by reference herein.

REFERENCE SIGNS LIST

1 Recording apparatus
2 Medium setting section
3 Medium moving section
5 Recording section
21 Ejecting section
22 Pretreatment section
23 Leveling section
D1 First direction
D2 Second direction
M Recording medium
Ma Recording surface

The invention claimed is:

1. A recording apparatus comprising:

a medium setting section on which a recording medium is set;

a recording section that records an image on the recording medium set on the medium setting section; and a medium moving section that relatively reciprocates the medium setting section with respect to the recording section in a first direction and a second direction opposite to the first direction, wherein the recording section includes a pretreatment section that supplies a pretreatment liquid to the recording medium set on the medium setting section when the medium setting section relatively moves in the first direction, a leveling section that is provided on a further downstream side with respect to the pretreatment section in the first direction and levels a recording surface of the recording medium to which the pretreatment liquid is supplied when the medium setting section relatively moves in the first direction, and a supplying section that supplies ink to a leveled recording surface when the medium setting section relatively moves in the second direction.

2. The recording apparatus according to claim 1, wherein the medium setting section has a medium mounting surface on which the recording medium is mounted, and wherein the recording apparatus further comprises a first floating detection section that is provided on a further upstream side with respect to the supplying section in the second direction and detects presence or absence of floating of the recording medium with respect to the medium mounting surface.

3. The recording apparatus according to claim 2, wherein a separation distance between the first floating detection section and the supplying section is greater than a dimension of the medium mounting surface in a reciprocation direction of the medium setting section.

4. The recording apparatus according to claim 1, wherein the recording section further includes a housing in which the pretreatment section, the leveling section, and the supplying section are housed, and an entrance is provided, and wherein the medium moving section moves the medium setting section from a moving start position provided outside of the housing to a returning position provided inside of the housing with respect to the recording section in the first direction, and moves the medium setting section from the returning position to the moving start position in the second direction.

5. The recording apparatus according to claim 1, wherein the medium setting section has the medium mounting surface on which the recording medium is mounted, and wherein the recording apparatus further comprises a second floating detection section that is provided on a further upstream side with respect to the supplying section in the first direction and detects presence or absence of floating of the recording medium with respect to the medium mounting surface.

6. The recording apparatus according to claim 1, wherein the pretreatment section includes a spray head that sprays the pretreatment liquid, and wherein the recording section further includes a partition member that partitions the spray head from the supplying section.

7. A recording method in a recording apparatus including a recording section that includes a pretreatment section that supplies a pretreatment liquid to a recording medium, a leveling section that is provided on a further downstream side with respect to the pretreatment section in a first direction and levels a recording surface of the recording medium, and a supplying section that supplies ink to the recording medium; and a medium moving section that relatively reciprocates the recording section with respect to the recording medium in the first direction and a second direction opposite to the first direction, the recording method comprising:

supplying the pretreatment liquid to the recording medium and leveling the recording surface to which the pretreatment liquid is supplied when the recording section relatively moves in the first direction with respect to the recording medium; and supplying ink to a leveled recording surface when the recording section relatively moves with respect to the recording medium in the second direction.

* * * * *